US009801251B2

(12) United States Patent
Moore

(10) Patent No.: US 9,801,251 B2
(45) Date of Patent: Oct. 24, 2017

(54) SYSTEMS AND METHODS FOR SELECTION OF DISPLAY MODE USING A SINGLE BUTTON LIGHTING MODULE

(71) Applicant: Playhard, Inc., Boulder, CO (US)

(72) Inventor: Jerry Moore, Boulder, CO (US)

( * ) Notice: Subject to any disclaimer, the term of this patent is extended or adjusted under 35 U.S.C. 154(b) by 0 days.

(21) Appl. No.: 15/230,207

(22) Filed: Aug. 5, 2016

(65) Prior Publication Data

US 2017/0041999 A1 Feb. 9, 2017

Related U.S. Application Data

(60) Provisional application No. 62/201,487, filed on Aug. 5, 2015.

(51) Int. Cl.
*H05B 33/08* (2006.01)
*H05B 37/02* (2006.01)

(52) U.S. Cl.
CPC ..... *H05B 33/0863* (2013.01); *H05B 33/0845* (2013.01); *H05B 37/0281* (2013.01)

(58) Field of Classification Search
CPC ..... H05B 33/0863; H05B 37/0281; H05B 33/0845
See application file for complete search history.

(56) References Cited

U.S. PATENT DOCUMENTS 6,611,244 B1 8/2003 Guritz
6,678,215 B1 * 1/2004 Treyz ..... G04G 13/028 368/10
9,113,513 B1 * 8/2015 Jungwirth ..... H05B 33/0815
2007/0195526 A1 * 8/2007 Dowling ..... H05B 33/0857 362/234
2007/0274420 A1 * 11/2007 Billings ..... H03J 1/0008 375/344
2011/0279673 A1 * 11/2011 Teich ..... B63B 49/00 348/148
2014/0203710 A1 * 7/2014 Li ..... H05B 33/0857 315/129
2016/0227620 A1 * 8/2016 Soles ..... H05B 33/0863
2017/0034893 A1 * 2/2017 Chen ..... H05B 37/0227

FOREIGN PATENT DOCUMENTS

EP 1528785 A1 5/2005

OTHER PUBLICATIONS

International Search Report and Written Opinion dated Nov. 2, 2016 issued in co-pending PCT App. No. PCT/US2016/045888 (8 pages).

* cited by examiner

*Primary Examiner* — Crystal L Hammond
(74) *Attorney, Agent, or Firm* — Haynes and Boone, LLP

(57) ABSTRACT

A method for a user to select the color displayed by a multicolor LED device comprises a timed sequence display of color choices and sensing of a corresponding selection by user input.

18 Claims, 1 Drawing Sheet

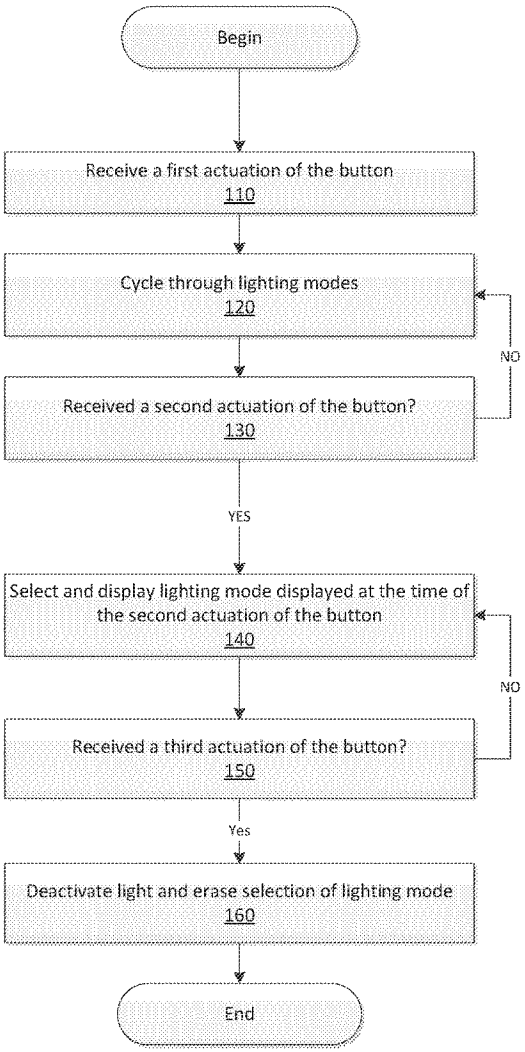
Begin
Receive a first actuation of the button
110
Cycle through lighting modes
120
NO
Received a second actuation of the button?
130
YES
Select and display lighting mode displayed at the time of the second actuation of the button
140
NO
Received a third actuation of the button?
150
Yes
Deactivate light and erase selection of lighting mode
160
End

SYSTEMS AND METHODS FOR SELECTION OF DISPLAY MODE USING A SINGLE BUTTON LIGHTING MODULE

CROSS-REFERENCE TO RELATED APPLICATIONS

This application claims the benefit of U.S. Provisional Application No. 62/201,487, filed on Aug. 5, 2015, which is incorporated herein by reference in its entirety.

FIELD

This disclosure relates in general to light emitting diodes (LEDs), and more particularly to methods for controlling the selection and display of individual colors from a range of colors emitted by multicolor LEDs.

BACKGROUND

The efficiency, reliability, and compact size of LEDs make them increasingly attractive for use in lighting devices of all kinds. LEDs originally were available only in individual discrete colors. When monochromatic LEDs are utilized in products for group recreation or entertainment (balls, flying discs, headbands, bicycle lights, goal markers, fan appreciation paraphernalia, etc.), the consumer can choose from a wide variety of colors available. However, if the recreational activity requires differentiation of individual players or teams by color, the user would need to purchase and keep on hand multiple different colored versions of the particular device. This is expensive, unwieldy, and inefficient.

With the advent of technology, LED devices have recently become available and affordable that comprise two or more single and differing color semiconductor dies compactly arranged on a single small platform and further include a dedicated onboard or external microprocessor that can separately control the relative brightness and on/off duty cycle of each individual light emitting die. Through appropriate programming of the microprocessor, the mixture of the light produced by the multiple color dies within the package can produce a wide array of spectral color and intensity emitted from the device. Incorporating multicolor LEDs in the recreational and entertainment products noted above would give the user the ability to own a single product and adjust its color output to match those of their team members or, alternatively, differentiate it from the color of opponent devices. What is required is a simple, direct, and easily monitored method to allow the user of a multicolor LED device to select the color to be displayed without needing to program a microprocessor or follow a complicated protocol for changing settings on the device.

SUMMARY

In one embodiment, a method for selecting a display mode on a lighting module, the lighting module having only a single button, includes receiving a first actuation of the single button at the lighting module. The method further includes, responsive to the first actuation, displaying a sequence of display modes by activating a light of the lighting module; receiving a second actuation of the single button at the lighting module; and responsive to the second actuation, displaying a selected display mode of the sequences of display modes corresponding to a displayed mode displaying at a time the second actuation was received. In one alternative, the method further includes receiving a third actuation of the single button at the lighting module; and responsive to the third actuation, deactivating the lighting module. Optionally, the sequence of display modes is a sequence of different color illuminations of the lighting module. In another alternative, the sequence of display modes is a sequence of different colors and patterns of illuminations of the lighting module. In another alternative, a microprocessor that is part of the lighting module receives inputs and produces the sequence of display modes. In one configuration, each display mode of the sequence of display modes is displayed for a standard time period. Optionally, the standard time period is between one to five seconds. In another embodiment, the lighting module includes an LED, and the LED changes colors and patterns to present the sequence of display modes.

In one embodiment, a system for lighting that includes a mode selection system includes a lighting module. The lighting module includes a light source, a microprocessor, and a button.

The microprocessor is configured to execute stored instructions to receive a first actuation of the button at the lighting module. The microprocessor is configured to execute stored instructions responsive to the first actuation, display a sequence of display modes by activating the light source of the lighting module, and receive a second actuation of the button at the lighting module.

The microprocessor is configured to execute stored instructions responsive to the second actuation, display a selected display mode of the sequences of display modes corresponding to a displayed mode displaying at a time the second actuation was received. Optionally, the microprocessor is further configured to execute stored instructions to receive a third actuation of the single button at the lighting module; and responsive to the third actuation, deactivate the lighting module. In one alternative, the sequence of display modes is a sequence of different color illuminations of the lighting module. In another alternative, the sequence of display modes is a sequence of different colors and patterns of illuminations of the lighting module. Optionally, the microprocessor that is part of the lighting modules receives inputs and produces the sequence of display modes. Alternatively, each display mode of the sequence of display modes is displayed for a standard time period. Optionally, the standard time period is between one to five seconds. In one configuration, the lighting module includes an LED, and the LED changes colors and patterns to present the sequence of display modes.

In one embodiment, a method for selecting a display mode on a lighting module, the lighting module having only a single button, includes receiving a first actuation of the single button at the lighting module. The method further includes, responsive to the first actuation, displaying a sequence of display modes by activating a light of the lighting module. The method includes awaiting a second actuation of the single button and continuing to display the sequence of displays. The method includes receiving the second actuation of the single button at the lighting module. The method includes, responsive to the second actuation, displaying a selected display mode of the sequences of display modes corresponding to a displayed mode displaying at a time the second actuation was received. In one alternative, the method further includes awaiting a third actuation of the single button and continuing to display the displayed mode displaying at the time the second actuation was received. The method further may include receiving the third actuation of the single button at the lighting module and, responsive to the third actuation, deactivating the lighting module.

BRIEF DESCRIPTION OF THE DRAWING

FIG. 1 shows a flow chart of one embodiment of a method for selecting a display mode using a single button lighting module.

DETAILED DESCRIPTION

Certain terminology is used herein for convenience only and is not to be taken as a limitation on the embodiments of the systems and methods for a selection of display mode using a single button lighting module.

Small lighting modules commonly are incorporated into devices, toys, and tools. These small lighting modules commonly include batteries, an LED, a circuit board for driving the LED, and a harness or other fitting for keeping the module together. The circuit board in many configurations may include a microprocessor that drives the LED and causes it to produce different colors and different patterns of flashing of the LED or changes in intensity.

Many times, users desire to select a particular pattern of display. With only one button, it is difficult to realize an easily used method for selecting the pattern or mode of display.

One method is to have the user actuate the button one time to change from one display setting to another. If the module has six display settings (a not uncommon number), this means every time the user activates and deactivates the system, the user will press or actuate the button seven times (a number of times to reach the setting the user desires and then a number of additional times to reach the sixth setting, and one final time to shut it off.

This leads to a lot of actuation of the button, which may be cumbersome for the user. This may also cause significant wear on the button of the lighting module. This may cause the lighting module to wear out quickly and no longer function.

Therefore, a system and method that only utilizes one button in a small lighting module to produce numerous different lighting patterns or modes is desirable. In many embodiments, this reduction in button pressing is achieved by having a single press of the button activate a mode presentation sequence or a sequence of modes. This means that upon a first push of the button from an "off" setting, the system cycles through the lighting modes, presenting each one for a short period of time (typically a number of seconds). This cycling continues until a user again presses the button during the display of one of the modes. This indicates that the user has selected that mode, and that mode then is continuously displayed. Another push of the button then deactivates the system.

Embodiments of the systems and methods for selection of display mode using a lighting module provides a method to simply and directly select a single discrete color to be displayed by a multicolor LED device. The following steps describe one embodiment of the selection method as used with such a device:

1. Upon startup, the multicolor LED device begins a preprogrammed timed sequence display of changing colors. The sequence has a duration determined by the number of color and intensity options available.
2. As the initial color sequence is running and displayed, the microprocessor awaits a selection input from the user by a button push or other input.
3. When the microprocessor senses a user selection input during the initial color sequence, the program is halted and the color intensity and hue settings at the time of the selection input are stored and used for the fixed color display.
4. If the microprocessor does not sense a user selection during the initial color sequence, the color sequence continues to repeat until the device is turned off.
5. Turning the device off erases the last settings of the fixed color display.
6. To revise or restore the fixed color display, return to Step #1.

The repeat of colors in Step #4 is itself a display mode that may be desirable for users as well.

FIG. 1 shows a flow chart representing one embodiment of a method for selecting a lighting mode of a small lighting module, using a single button. The lighting module begins in an inactive state. In step 110, the lighting module receives a first actuation of the button. In response, in step 120, the lighting module begins to cycle through the lighting modes, presenting each one for a few seconds (or some other short period of time). In step 130, if the module has not received a second actuation, the flow returns to step 120 and the cycling continues.

If the lighting module receives a second actuation, then flow continues to step 140. In step 140, whatever mode was displayed at the time of the second actuation is continuously displayed. In step 150, if a third actuation of the button is not received, the system then continues to display the selected mode. If a third actuation is received, in step 160, the light is deactivated and the selected mode is erased. The process then terminates.

Embodiments of the method deployed in the lighting module may occur primarily in the microprocessor. The microprocessor may include software in various embodiments. Various embodiments of the systems and methods for controlling the lighting module may be implemented fully or partially in software and/or firmware. This software and/or firmware may take the form of instructions contained in or on a non-transitory computer-readable storage medium. Those instructions then may be read and executed by one or more processors to enable performance of the operations described herein. The instructions may be in any suitable form such as, but not limited to, source code, compiled code, interpreted code, executable code, static code, dynamic code, and the like. Such a computer-readable medium may include any tangible non-transitory medium for storing information in a form readable by one or more computers such as, but not limited to, read only memory (ROM), random access memory (RAM), magnetic disk storage media; optical storage media; a flash memory, etc.

What is claimed as new and desired to be protected by Letters Patent of the United States is:

1. A method for selecting a display mode on a lighting module, the lighting module having only a single button, the method comprising:

receiving a first actuation of the single button at the lighting module;

responsive to the first actuation, displaying a sequence of display modes by activating a light of the lighting module;

receiving a second actuation of the single button at the lighting module; and responsive to the second actuation, displaying a selected display mode of the sequences of display modes corresponding to a displayed mode displaying at a time the second actuation was received.

2. The method of claim 1, further comprising:

receiving a third actuation of the single button at the lighting module; and responsive to the third actuation, deactivating the lighting module.

3. The method of claim 2, wherein the sequence of display modes is a sequence of different color illuminations of the lighting module.

4. The method of claim 2, wherein the sequence of display modes is a sequence of different colors and patterns of illumination of the lighting module.

5. The method of claim 1, wherein a microprocessor that is part of the lighting module receives inputs and produces the sequence of display modes.

6. The method of claim 1, wherein each display mode of the sequence of display modes is displayed for a standard time period.

7. The method of claim 6, wherein the standard time period is between one to five seconds.

8. The method of claim 1, wherein the lighting module includes an LED, and the LED changes colors and patterns to present the sequence of display modes.

9. A system for lighting that includes a mode selection system, comprising:

a lighting module;

the lighting module including:

a light source;

a microprocessor; and a button;

the microprocessor configured to execute stored instructions to:

receive a first actuation of the button at the lighting module;

responsive to the first actuation, display a sequence of display modes by activating the light source of the lighting module;

receive a second actuation of the button at the lighting module; and responsive to the second actuation, display a selected display mode of the sequences of display modes corresponding to a displayed mode displaying at a time the second actuation was received.

10. The system of claim 9, wherein the microprocessor is further configured to execute stored instructions to:

receive a third actuation of the single button at the lighting module; and responsive to the third actuation, deactivate the lighting module.

11. The system of claim 10, wherein the sequence of display modes is a sequence of different color illuminations of the lighting module.

12. The system of claim 10, wherein the sequence of display modes is a sequence of different colors and patterns of illumination of the lighting module.

13. The system of claim 10, wherein the microprocessor that is part of the lighting module receives inputs and produces the sequence of display modes.

14. The system of claim 10, wherein each display mode of the sequence of display modes is displayed for a standard time period.

15. The system of claim 14, wherein the standard time period is between one to five seconds.

16. The system of claim 10, wherein the lighting module includes an LED, and the LED changes colors and patterns to present the sequence of display modes.

17. A method for selecting a display mode on a lighting module, the lighting module having only a single button, the method comprising:

receiving a first actuation of the single button at the lighting module;

responsive to the first actuation, displaying a sequence of display modes by activating a light of the lighting module;

awaiting a second actuation of the single button and continuing to display the sequence of displays;

receiving the second actuation of the single button at the lighting module; and responsive to the second actuation, displaying a selected display mode of the sequences of display modes corresponding to a displayed mode displaying at a time the second actuation was received.

18. The method of claim 17, further comprising:

awaiting a third actuation of the single button and continuing to display the displayed mode displaying at the time the second actuation was received;

receiving the third actuation of the single button at the lighting module; and responsive to the third actuation, deactivating the lighting module.

* * * * *